US007412808B2

(12) United States Patent
Lavi

(10) Patent No.: US 7,412,808 B2
(45) Date of Patent: Aug. 19, 2008

(54) FOOD SERVICE SET ASSEMBLY SYSTEM

(75) Inventor: Payam Lavi, Oceanside, CA (US)

(73) Assignee: Convenience Enterprises, Inc., Oceanside, CA (US)

( * ) Notice: Subject to any disclaimer, the term of this patent is extended or adjusted under 35 U.S.C. 154(b) by 0 days.

(21) Appl. No.: 11/044,538

(22) Filed: Jan. 26, 2005

(65) Prior Publication Data

US 2005/0166548 A1 Aug. 4, 2005

Related U.S. Application Data

(60) Provisional application No. 60/539,545, filed on Jan. 26, 2004, provisional application No. 60/581,735, filed on Jun. 22, 2004.

(51) Int. Cl.
*B65B 11/10* (2006.01)

(52) U.S. Cl. ..... 53/228; 53/155; 53/582

(58) Field of Classification Search ..... 53/399, 53/419, 425, 445, 461, 466, 137.2, 154, 155, 53/582, 586, 228, 238, 250
See application file for complete search history.

(56) References Cited

U.S. PATENT DOCUMENTS 5,019,112 A * 5/1991 Engelhardt et al. ..... 53/155
5,237,801 A * 8/1993 Hillam et al. ..... 53/238
5,428,941 A * 7/1995 Staub ..... 53/399
5,469,688 A 11/1995 Dunbar et al.
6,023,908 A 2/2000 Vetsch
6,023,913 A 2/2000 Gray et al.
6,202,387 B1 * 3/2001 Brown et al. ..... 53/137.2
6,615,566 B2 * 9/2003 Heisey ..... 53/229
6,918,226 B2 * 7/2005 Heilman et al. ..... 53/228
2004/0237475 A1 * 12/2004 Rubin ..... 53/461

* cited by examiner

*Primary Examiner*—Louis Huynh
(74) *Attorney, Agent, or Firm*—Mintz, Levin, Cohn, Ferris, Glovsky and Popeo, P.C.

(57) ABSTRACT

A device and method for assembling a food service set comprising at least one napkin wrapped around one or more utensils and secured by an adhesive band. The device includes a magazine subsystem including one or more magazines for containing and dispensing the at least one napkin, the one or more utensils, and the adhesive band. The device further includes an integrator subsystem configured to integrate the at least one napkin, the one or more utensils, and the adhesive band together. A processor subsystem is configured to roll the at least one napkin around the one or more utensils and to secure the adhesive band around the at least one napkin. A receiver subsystem is configured for receiving the service set. A sterilization system is provided to sterilize the utensils prior to, or after, being assembled into a service pack.

16 Claims, 10 Drawing Sheets

FOOD SERVICE SET ASSEMBLY SYSTEM

CROSS REFERENCE TO RELATED APPLICATIONS

This application claims priority to U.S. Provisional Applications Ser. No. 60/539,545, filed on Jan. 26, 2004, and Ser. No. 60/581,735, filed on Jun. 22, 2004.

BACKGROUND

The present invention relates generally to packaging one or more food utensils, and more particularly to an apparatus and method for assembling a service set having one or more utensils wrapped by a napkin.

Despite advances in automation, many processes within the food service industry are still largely manual. For example, preparing and providing a napkin and utensils for use by a customer is typically done manually. Some food service establishments, especially those that serve a large number of customers, attempt to conserve time by providing a "service set," that is, one or more utensils wrapped inside a napkin and secured by a piece of paper tape. The service pack can then be given to a customer so that setting utensils and the napkin at a table is unnecessary. Unfortunately, large amounts of manual labor time are still consumed in the formation of these service packs.

For each service set, a human must still select and bundle one or more utensils must still be manually bundled, wrapped in a napkin and then sometimes taped in place. At large food service establishments, such as with large chain restaurants, hotels, casinos, resorts, etc., the labor costs involved in forming and providing a large number of service sets can be substantial, particularly when all costs such as wages or other compensation and benefits are taken into account. Further, human contact with the various components of a service pack during the assembly process can lead to contamination and the transmission of disease.

SUMMARY

An apparatus and method for assembling a service set are disclosed, for saving time and energy that would normally be required of a person to manually assemble such a service set. The apparatus and method for assembling a service set also achieve a high throughput for outputting assembled service sets. Further, human contact with the various components of a service set is minimized by the disclosed apparatus and method, minimizing the risk of contamination and transmission of disease.

A device for assembling a service pack is disclosed. A service pack includes a napkin and a utensil set. The device includes a folding stage, and a vacuum chuck configured to lift a napkin from a stack of napkins, and place the napkin onto the folding stage. The device further includes a grabber that moves to a utensil assembly holding a number of utensils, the grabber configured to pick up a utensil set from the number of utensils, and place the utensil set onto the napkin. The device further includes a sterilization mechanism, configured to sterilize the utensil set.

The details of one or more embodiments are set forth in the accompanying drawings and the description below. Other features, objects, and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

This document describes apparatuses and methods for assembling a service set, in which many previously manually-performed tasks are automated and performed to a high degree of precision. Further, these apparatuses and methods reduce potential contamination of any of the components of a service set to provide a service set that is free of germs and/or disease-causing agents.

Figure 1:
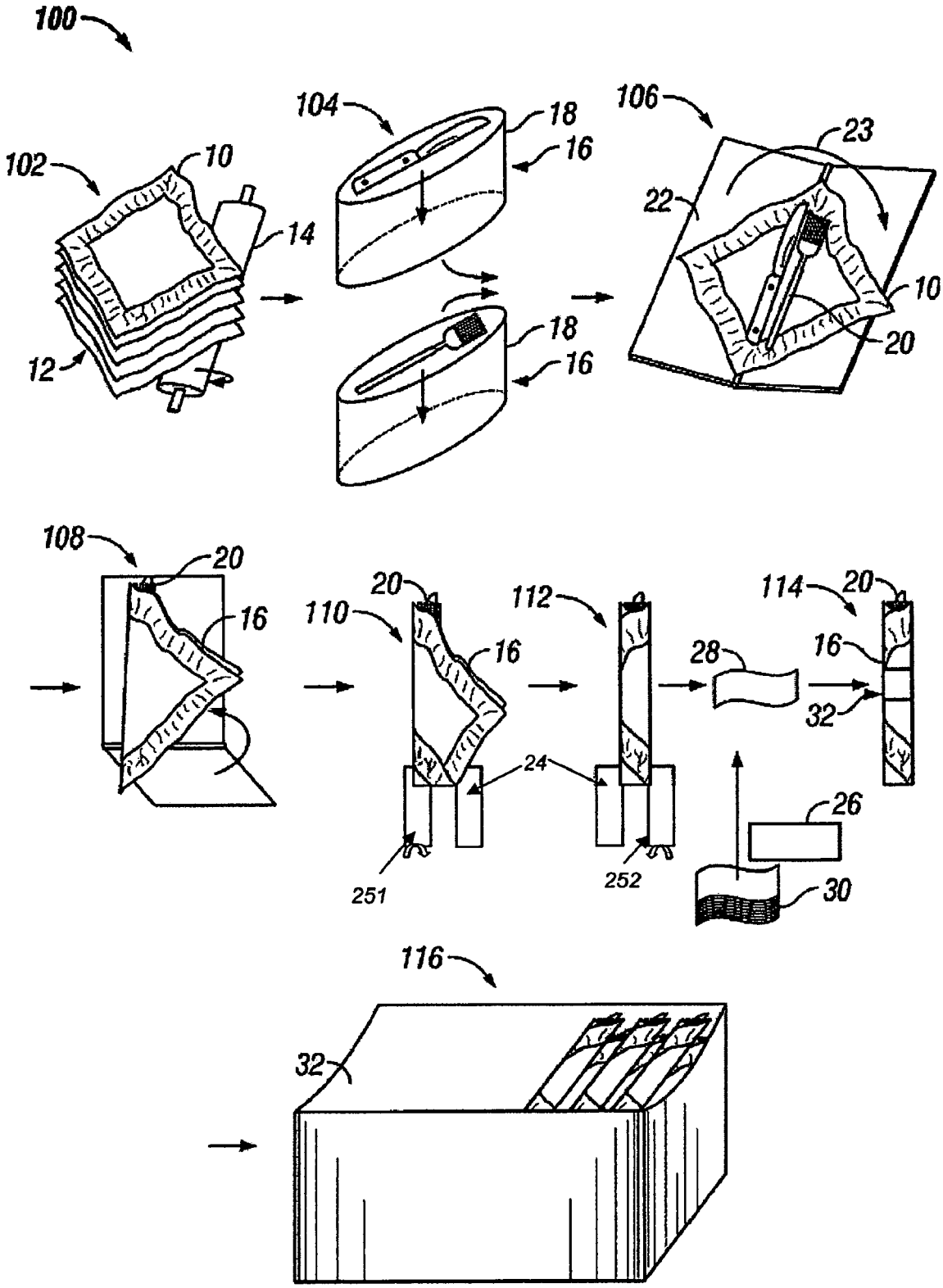
FIG. 1 graphically depicts a process for assembling a service set.

FIG. 1 graphically depicts a general process 100 for mechanically assembling a service set in accordance with one embodiment. At 102, a napkin 10 from a napkin stack 12 is provided to a napkin feeder 14, which feeds the napkin 10 to a receiving position at 106. At 104, one or more utensils 16 are provided to individual utensil feeders 18, which feeds the one or more utensils to the napkin 10 in the receiving position 106. The one or more utensils 16 may include a knife, a fork, a spoon, or some combination thereof. Each utensil feeder 18 may include a cartridge or other detachable holding mechanism that can be attached to a mechanism for holding and feeding the one or more utensils 16 one at a time to the napkin 10. In an alternative embodiment, a combination of utensils 16 may be provided to a single utensil feeder 18. The one or more utensils 16 provided to the napkin 10 in the receiving position 106 form a utensil set 20.

After the utensil set 20 has been fed to the napkin 10 in the receiving position 106, a folding mechanism 22 folds the napkin 10 around the utensil set 20, also shown at 108, to a folded position 110. The folding mechanism 22 can include a first folder for folding the napkin along a first axis 23 shown at 106, and a second folder for folding the napkin along a second axis 25, shown at 108, where the second axis 25 can be substantially normal to the first axis 23. Any sized portion of the napkin 10 can be part of the folding of the first or second folder. For example, as shown in FIG. 1, the first folder can fold the napkin 10 substantially in half, while the second folder may fold only a small lower portion of the napkin back on itself. The folding mechanism 22 may also be configured to perform all folds of the napkin 10 in one integrated step.

In the folded position the napkin 16 and utensil set 20 therein are provided to a rolling mechanism 24, at 110 and 112. The rolling mechanism 24 can include a first roller 251 for rolling the napkin 16 and utensil set 20 in a first, i.e. clockwise, direction, and a second roller 252 for rolling the napkin 16 and utensil set 20 in a second, i.e. counter-clockwise direction. The rolling mechanism 24 tightens the folded napkin 16 around the utensil set 20 to a rolled position, shown at 112. A tape feeder 26 provides a tape piece 28 from a tape stack or tape roll 30 to an outer surface of the napkin 16 that has been rolled around the utensil set 20 to secure the napkin 16 and utensil set 20 in a rolled-up position, and to complete the assembly of a service set 32, depicted at 114. The assembled service set 32 can then be provided to a basket or other type of service set holder.

Figure 2:
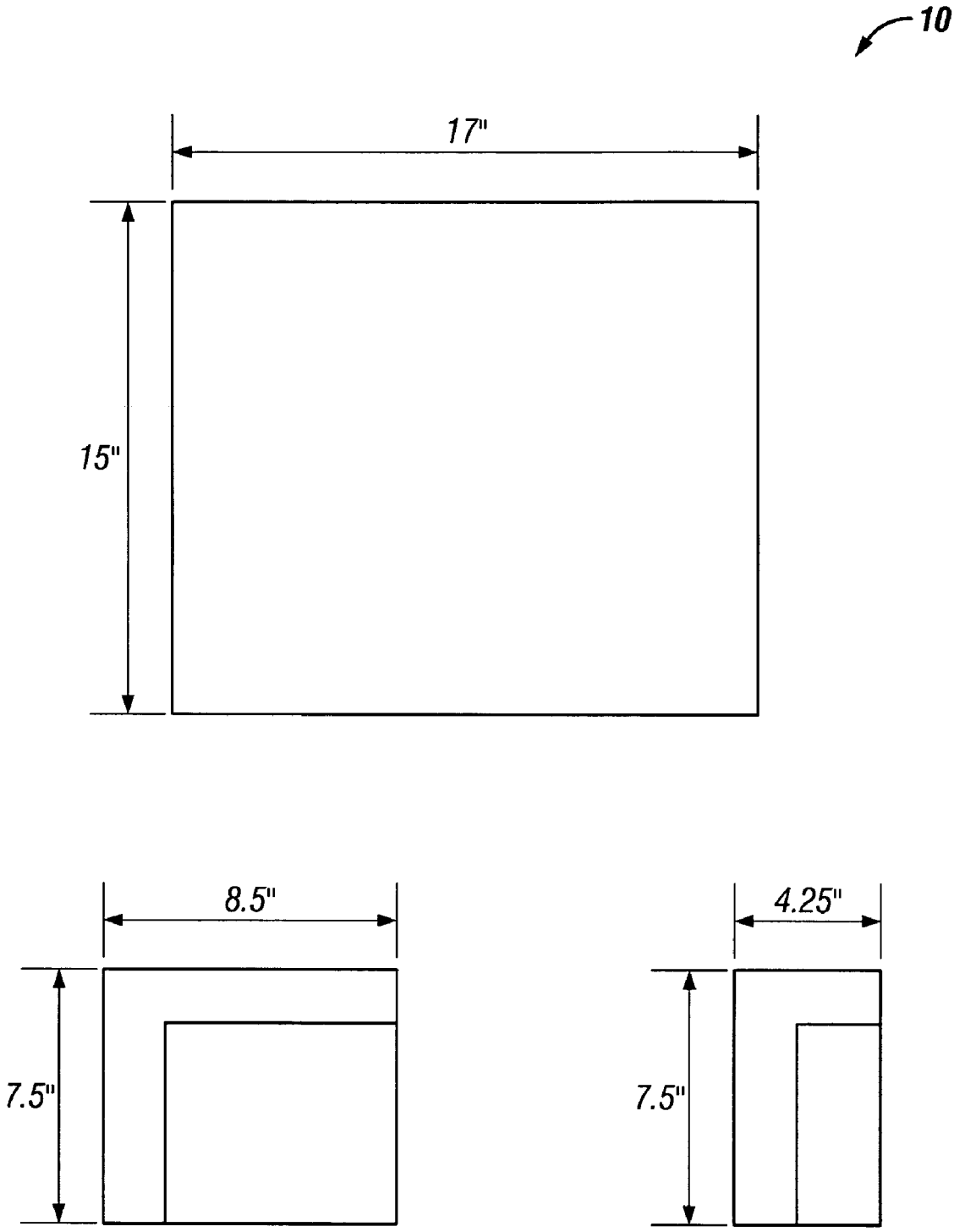
FIG. 2 illustrates a napkin and its various folds.
Figure 3:
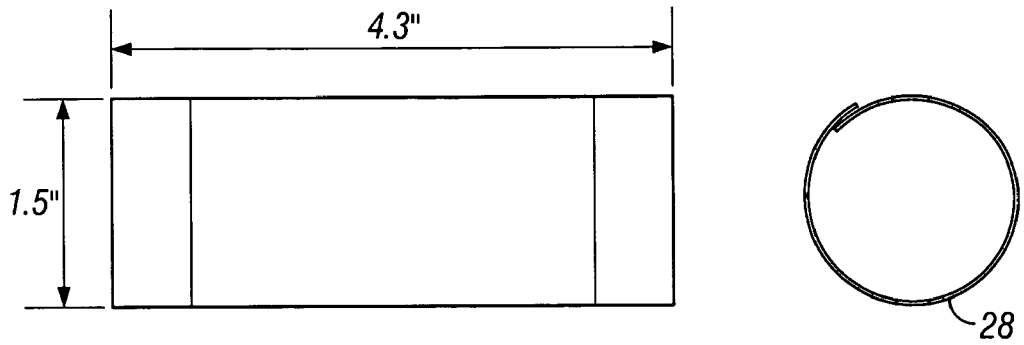
FIG. 3 illustrates a tap piece for securing a napkin around one or more utensils.

In one exemplary embodiment, the process for assembling a service pack utilizes a standard 15×17 inch napkin, however any size napkin 10 can be used, as shown in FIG. 2. The napkin 10 is preferably formed of paper, but linen or other cloth-like material napkin can also be used. As shown in FIG. 3, the tape piece 28 can include one or two adhesive end areas that are configured to adhere to each other. An adhesive can be provided on one or both adhesive end areas. In an embodiment, the adhesive end areas are provided on opposite sides of the tape piece 28, such that when the tape piece is rolled around the napkin 10 and utensil set 20, one adhesive end area is juxtaposed with, and at least partially overlaps, another adhesive end area.

In accordance with a specific embodiment, a service set includes the following: a napkin, such as those commonly available from restaurant supply houses, preferably in a "Quarter Fold" configuration, (unfolded, 15×17 inches); flatware or "Dinnerware Utensils", (knives and forks, and optionally spoons), which can be metallic or plastic, such as are commonly available from restaurant supply houses; a napkin band, which are also commonly available (in stacked format) from restaurant supply houses. In a specific embodiment, the napkin band is approximately 1.5×4.3 inches. The napkin bands are preferably paper strips with adhesive backing. The adhesive backing sticks to itself only and requires no treatment to activate the tackiness. The adhesive backing is a film applied to both sides of the strip but only at the (i.e. approximately 1.5" wide) opposite ends and extending approximately one third of the length from the end, as shown above with respect to FIG. 3.

Figure 4:
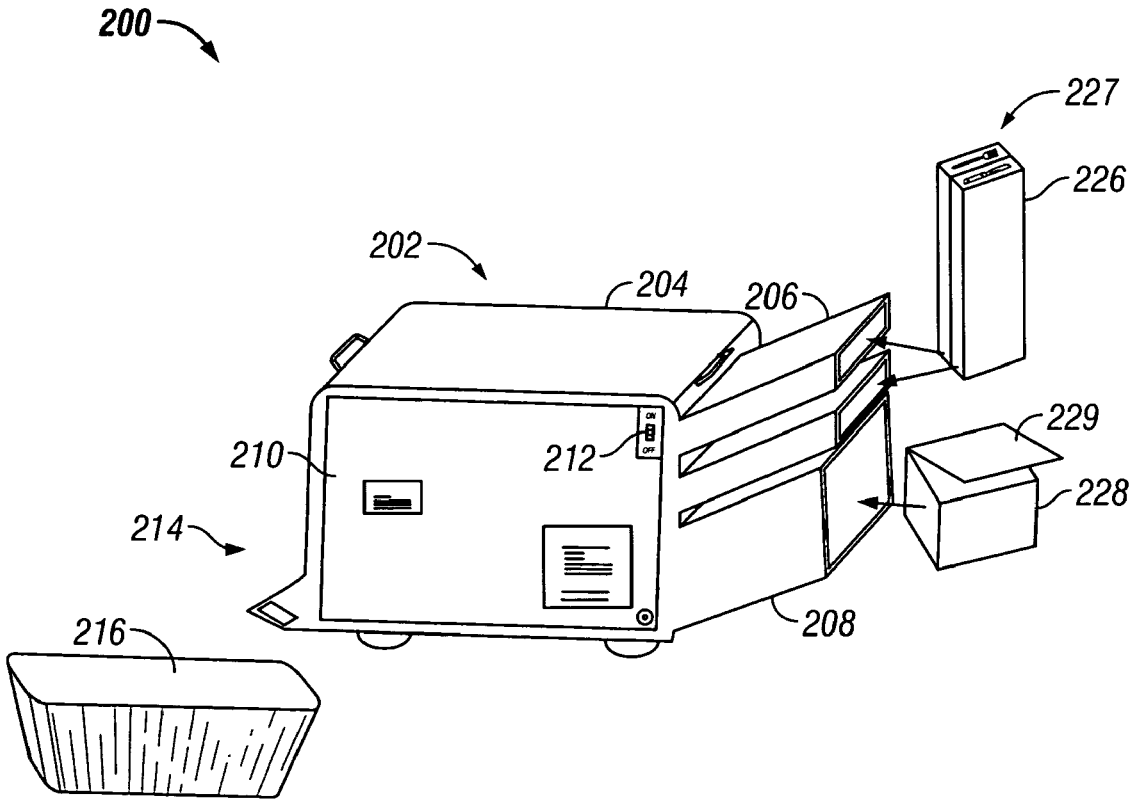
FIG. 4 is a perspective view of an apparatus for assembling a service set.

FIG. 4 shows a service set assembly system 200 in accordance with an exemplary embodiment. The system 200 includes an assembly device 202 configured to assemble and output a number of service sets, which includes utensils in a folded and/or rolled napkin contained by a tape piece or napkin band. The device 202 can use napkins, utensils and napkin bands typically found in restaurants, or napkins of unique dimensions, and a combination of common automation machine components such as pick-and-place assemblies, customized clamps, motorized linear and rotational bearings and slides, stepper motor and/or solenoid type actuators. An electronic control system 212 provides a control interface for activating the individual internal components of the device 202 in a particular sequence employed to assemble the service set.

This device 202 incorporates features that facilitate loading and installation of magazines, installation and removal of the receiver. The device 202 is easy to operate and includes safety features such as GFCI circuitry, an EPO switch and tamper-proof access panels for service. To increase reliability of the device, and to simplify manufacturing assembly and maintenance in the field, no hydraulics or pneumatics are employed with the preferred embodiment.

The device 202 includes a housing 204. The housing 204 is preferably squared or cubed, formed of rigid plastic or stainless steel, and may have a number of padded legs or feet on which the housing 204 is positioned upon a planar surface. The housing 204 includes one or more inlets 206 for receiving a cartridge 226 containing a number of utensils 228. For example, there may be two inlets 206, each for accepting individual cartridges 226 for forks and knives. A third inlet 206 may be provided to receive a cartridge 226 of spoons. The cartridges 226 provide the utensils 228 in a generally stacked configuration for serial placement to the device 202 one-at-a-time.

The housing 204 also includes a napkin inlet 208 that is sized and configured to receive a napkin cartridge 228 containing a stack of individual napkins 229. Alternatively, the stack of individual napkins 229 can be fed directly to the napkin inlet 208. The device 202 also includes an outlet 214 through which assembled service packs are sent to a basket 216 or other receiving mechanism.

Figure 5:
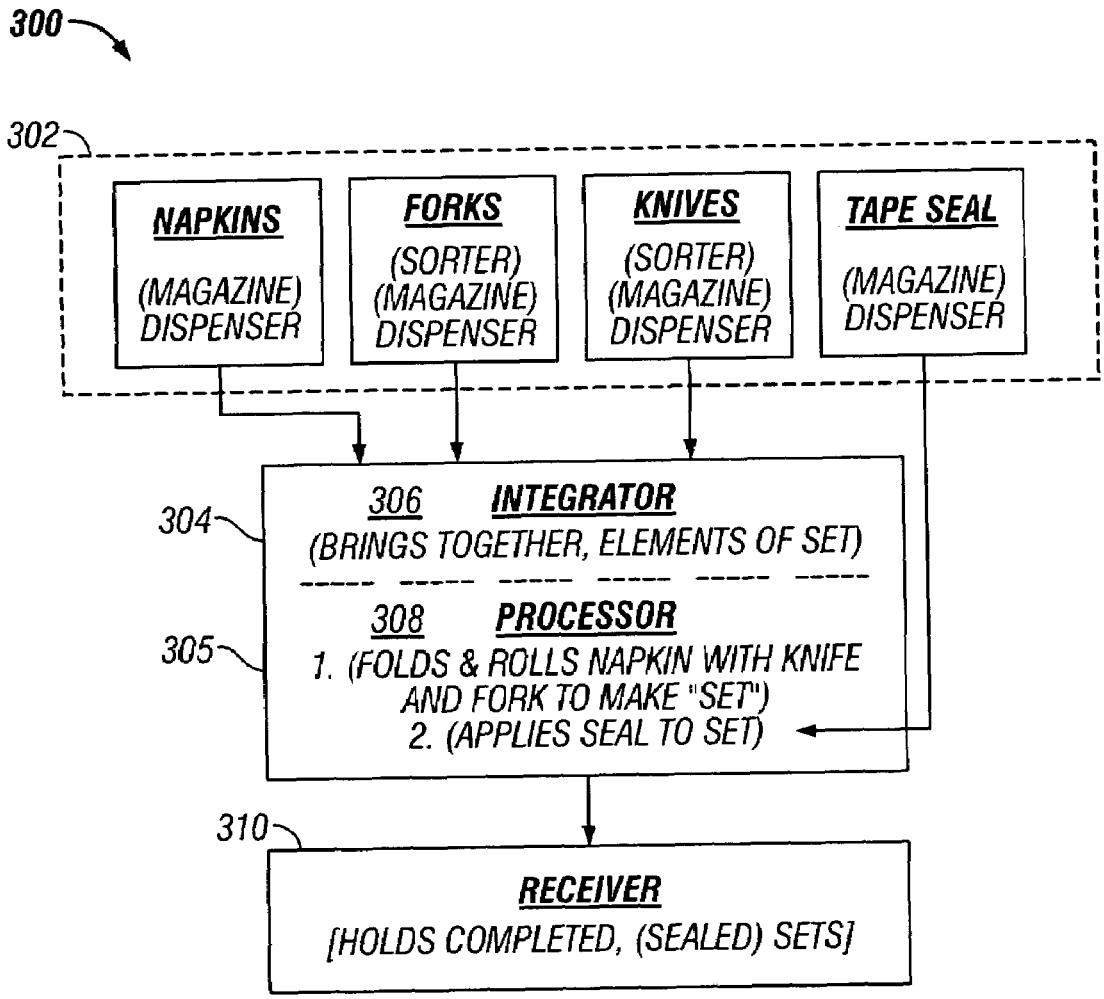
FIG. 5 is a block diagram of an apparatus.

In an alternative exemplary embodiment, a device 300 for assembling a service pack includes a number of sub-systems, as generally shown in FIG. 5. A magazine subsystem 302 includes one or more magazines for containing, sorting and/or dispensing the napkins, utensils and napkin bands. Each of these service pack components may be provided or dispensed in its own magazine, or a magazine may contain one or more items. An integrator subsystem 304 includes an integrator 306 that transfers the napkins and utensils from their magazines and positions them appropriately to a processor subsystem 305.

The processor subsystem 305 includes a processor 308 that folds and rolls a napkin to surround the utensils and then applies a napkin band to the napkin to form a service set. A receiver subsystem 310 includes a container that receives and holds the assembled, banded service set. These subsystems are described in further detail below. The receiver subsystem includes a basket-like container with a spring-loaded feature that facilitates a uniform filling of the container.

Figure 6:
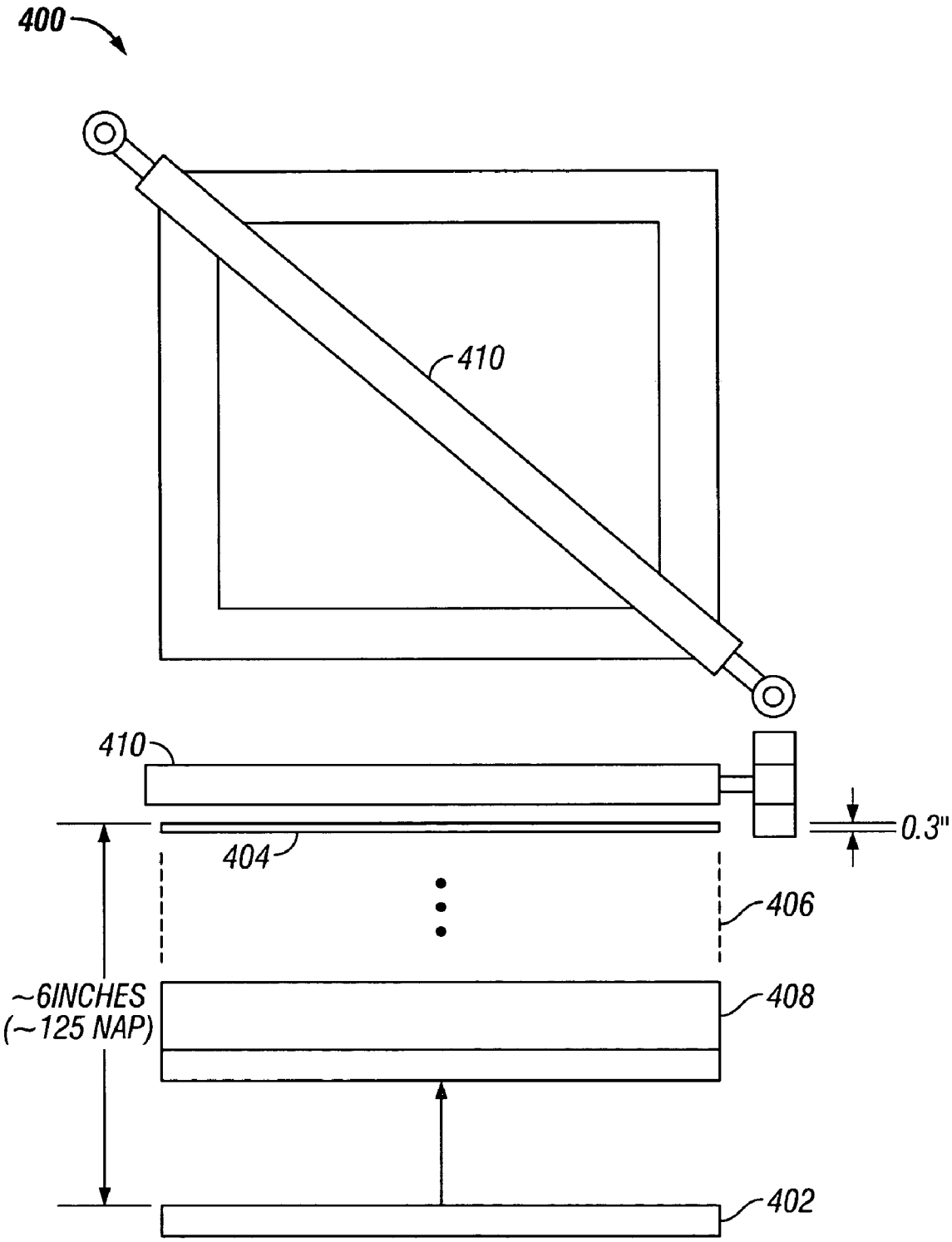
FIG. 6 is a plan view of a napkin magazine.

FIG. 6 is a plan view and side view of a napkin magazine 400. The napkin magazine 400 includes a spring-loaded plate 402 for supporting one or more napkins 404 in a napkin stack 406, and a foam pad 408 on the plate 402 to lift one or more corners of the last one or more napkins 404 in the napkin stack 406. The magazine 400 also includes a lift rod 410. The lift rod 410 lifts a selected number of napkins 404, i.e. one, from the napkin stack 406 for preparing the lifted napkin 404 for transfer to the integrator subsystem.

Figure 7:
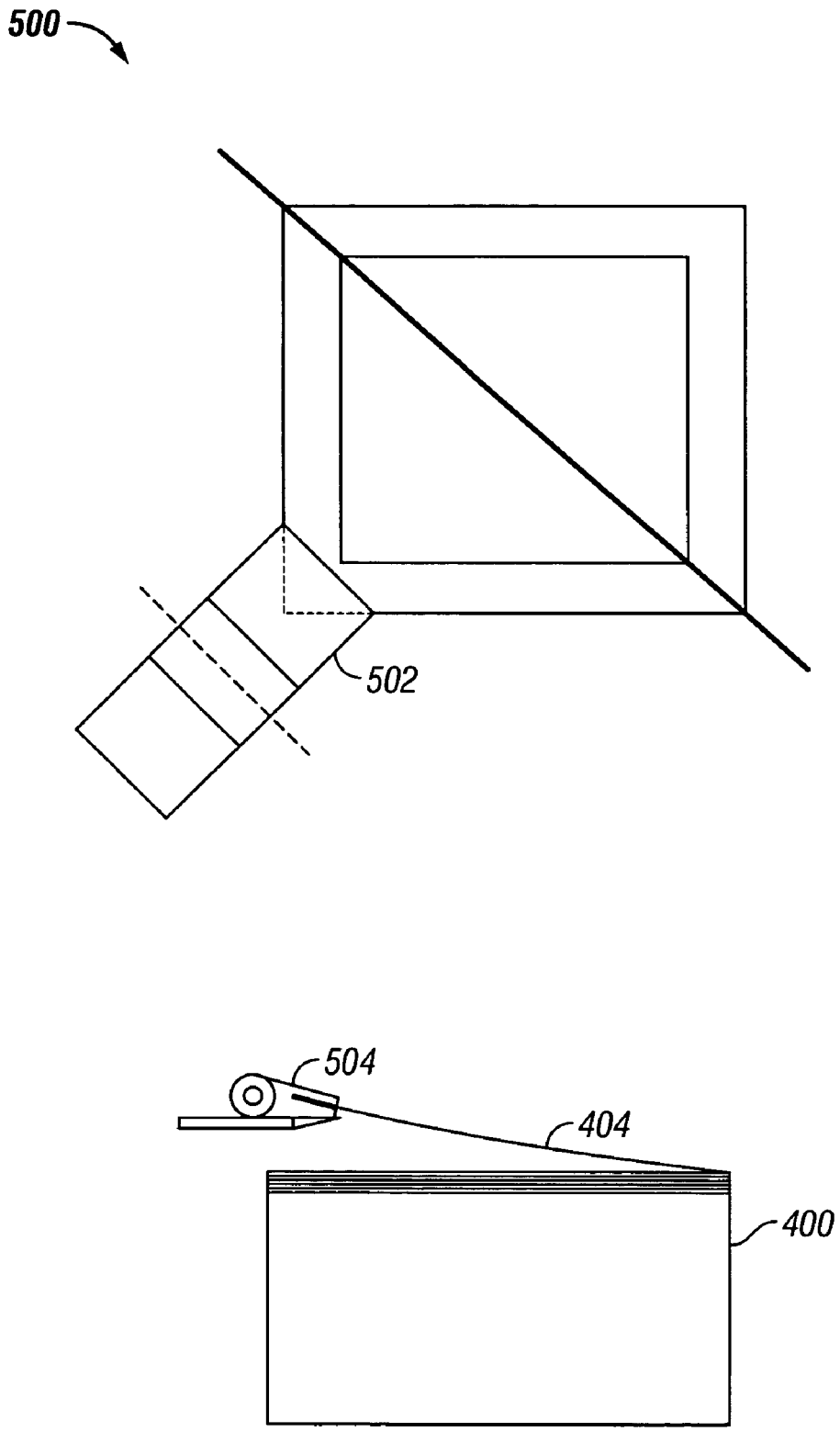
FIG. 7 includes plan and side views of a napkin magazine.

The integrator subsystem includes a napkin transfer assembly 500 that includes a clip and mechanism that picks a single napkin from its magazine and moves the napkin to a specific location in a particular orientation on the platen. FIG. 7 shows plan and side views of the napkin transfer assembly 500, in which an arm 502 is movable to the napkin magazine 400. The arm 502 includes a clip 504 that grasps a lifted corner of a napkin 404, and then moves the napkin 404 to the platen.

Figure 8:
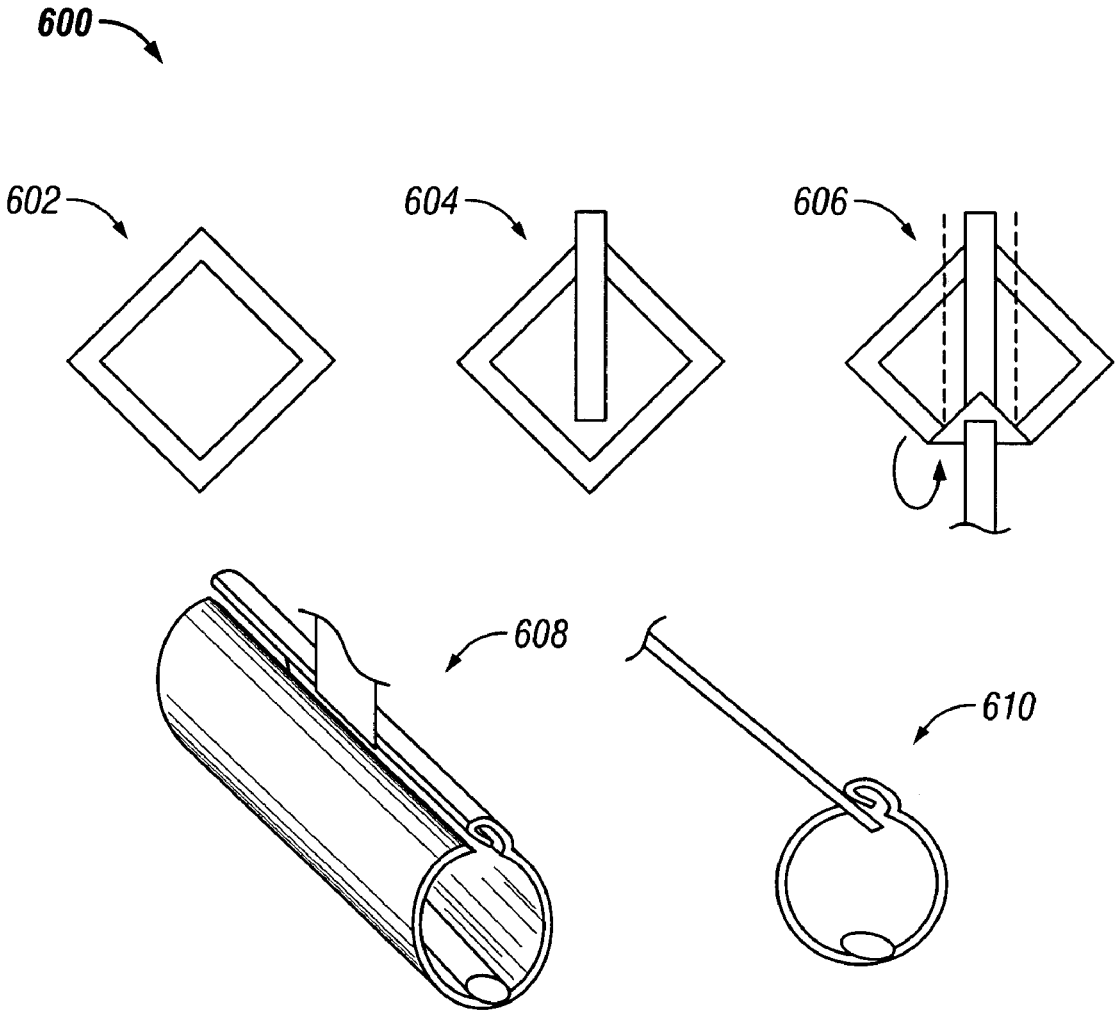
FIG. 8 illustrates a mechanical process for processing a napkin.

FIG. 8 graphically illustrates a process 600 by which a napkin is grabbed, positioned, folded, and rolled around set utensil to secure the utensil set inside the napkin. More particularly, the process 600 includes the following steps: transfer napkin from napkin magazine to platen (at 602); transfer fork from fork magazine to flatware clamp; transfer knife from knife magazine to flatware clamp; position loaded flatware clamp at napkin (604); move curler clamp to lift napkin corner into fold over handle ends of flatware (606); close curler clamp on folded napkin corner to capture flatware;

release flatware clamp; move open roller jaws to surround flatware and napkin (608); close roller jaws to capture flatware in napkin; rotate closed roller jaws, as many full revolutions as are required to complete "roll-up" of napkin (610); move napkin band from napkin band magazine to roller jaw insertion point; rotate closed roller jaws to apply napkin band to assembled service set; open roller jaws; and dispense banded service set into receiver.

As described above, one or more utensils can be combined in a common magazine, be separated in a common magazine, or be separated in separate magazines and fed individually. Additionally, one magazine may be provided with multiple compartments for storing and providing all of the components of a service set. The above-described method need not necessarily be performed in the order or manner described, and can include variations on one or more of the steps.

Figure 9:
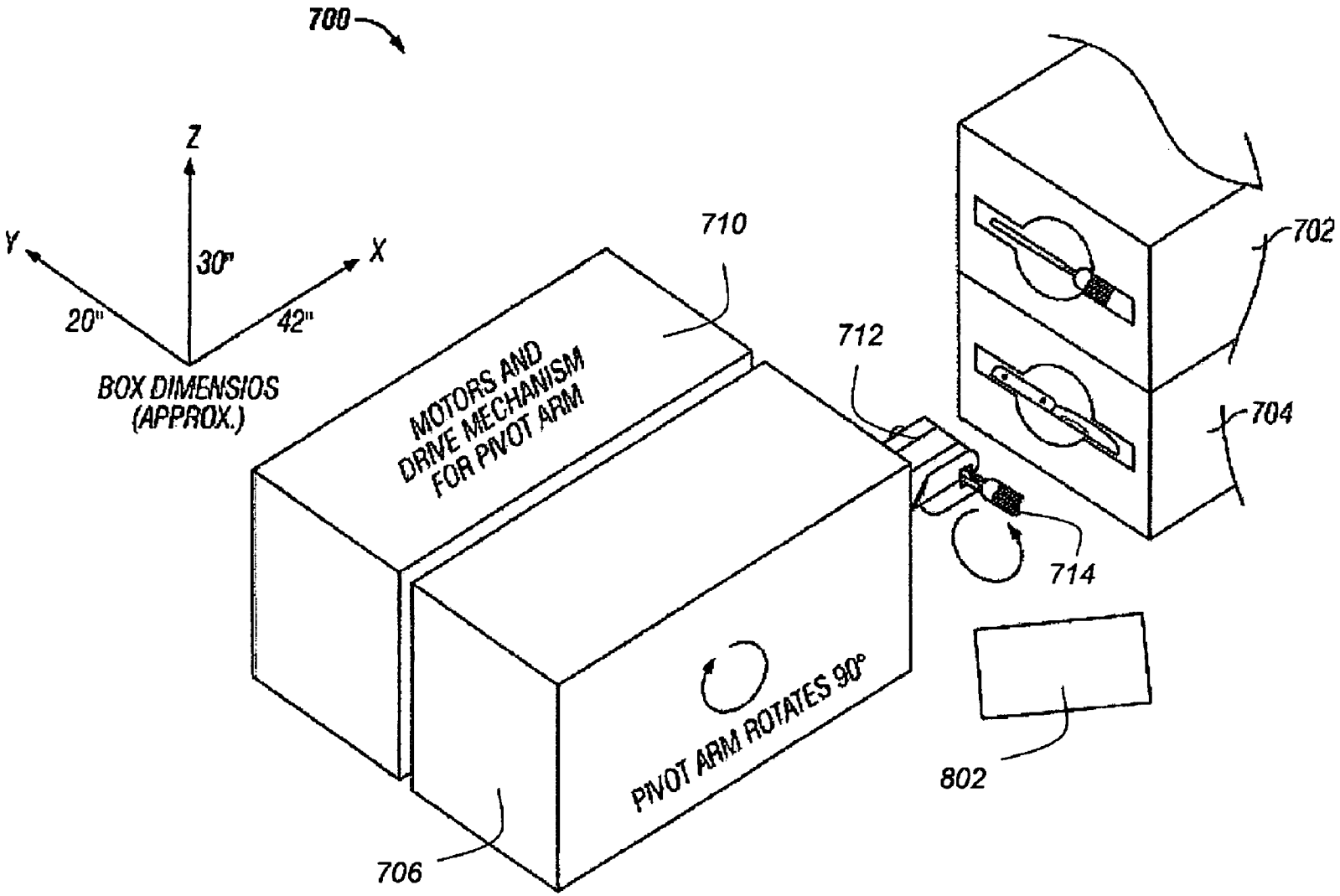
FIG. 9 is a perspective view of a portion of a service set assembly device.

FIG. 9 is a perspective view of a portion 700 of a service set assembly device, including a fork magazine and a knife magazine. These magazines can include a coil or other structure that is rotated to convey the items to a dispensing point. In a rifle configuration, the magazines are stacked in proximity to each other. In a bailing machine configuration, a row of utensils is lifted into the bailing mechanism by a moving belt which has protruding tines to engage and move the utensils. The magazines 702 and 704 are preferably compact, of simple construction, and allow one of a kind of utensil to be removed at a time. As shown in FIG. 9, the magazines 702, 704 can be positioned opposite a pivot arm 706 and a motor and drive mechanism 710 for rotating the pivot arm 706. The pivot arm 706 can include at its end closest to the magazines a jaw clamp 712 that can grasp a utensil 714 from one of the magazines 702, 704. positioned below the level of the pivot arm 706 and the magazines 702, 704 can be a platen 802 for receiving and holding a napkin and a curler clamp and roller jaws as well as motors for operating these devices to assemble the service set. The pivot arm 706 can be rotated 90° downward by the drive mechanism 710 after the jaw clamp 712 has grasped a utensil 714. In this manner the utensil 714 is delivered to the napkin on the platen 802. The jaw clamp can also be capable of rotation by 90° to orient the utensil 714 properly on the napkin. Also positioned below the pivot arm 706 and the magazines 702, 704 can be a napkin dispenser to provide a napkin to the platen 802. A napkin band facilitates extraction of a single band from either a stack or a roll format.

Figure 10:
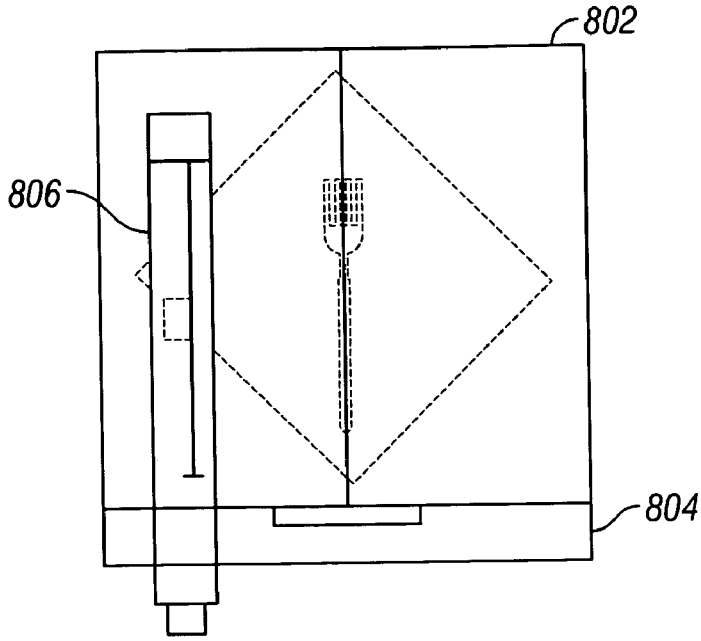
FIG. 10 is a plan view of a portion of a service set assembly device.

As illustrated in FIG. 10, the processor subsystem includes a platen 802. The platen is a two-part plate on which the napkin is positioned to facilitate the folding, rolling and banding processes. The processor subsystem further includes a curler clamp assembly 804. The curler clamp assembly 804 moves linearly to fold the napkin over the handle end of the utensil set, and closes to grasp the utensil set in the folded corner of the napkin. The curler clamp assembly 804 can be stationary while rolling and banding occurs.

A roller jaws assembly 806 surrounds the napkin and utensil set so as to facilitate the rolling of the napkin. The roller jaws assembly 806 is rotated to effect the rolling of the napkin. The roller jaws assembly 806 also introduces the napkin band to the napkin. The roller jaws assembly 806 is rotated again to effect the application of the band. When the service set has been banded, the roller jaws assembly is retracted. To dispense the banded service set into the receiver, one side of the platen may be tilted. This will allow the banded service set to be gravity-fed into a receiver.

Figure 11:
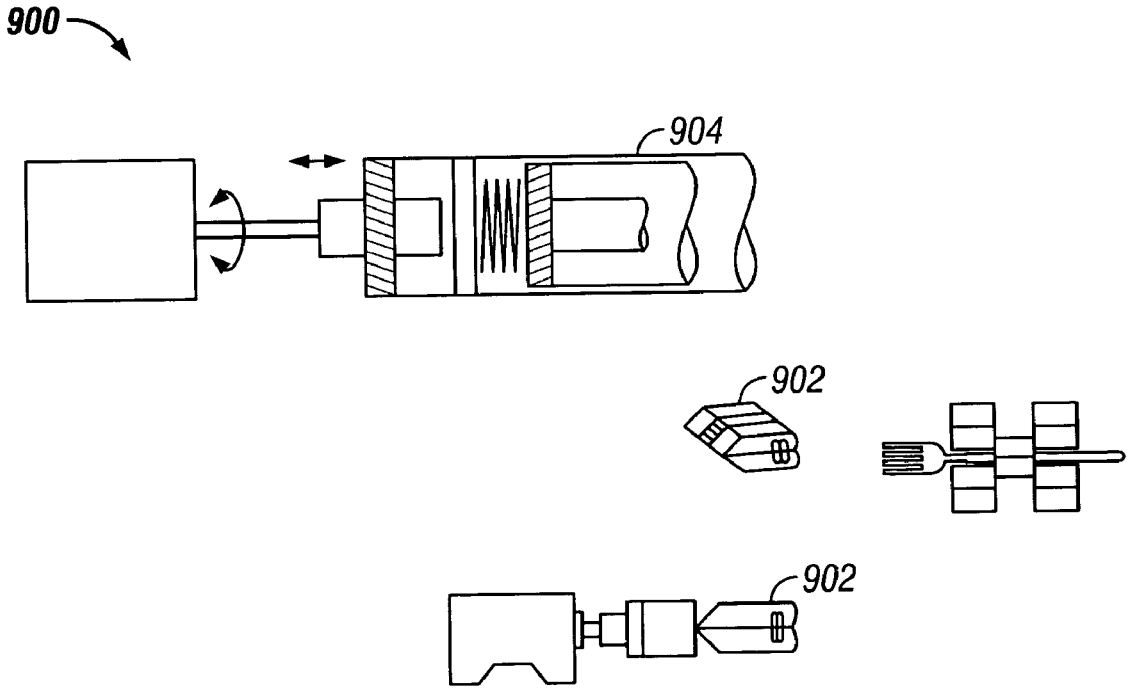
FIG. 11 shows a jaw clamp assembly for a service set assembly device.

FIG. 11 shows a flatware clamp assembly 900 that includes a clamp mechanism 902 that picks a single fork and knife from their respective magazines and moves them to a specific location on the napkin. The clamp mechanism is powered and controlled by a motorized linear motion mechanism 904, that opens a knife jaw while closing a fork jaw. Alternatively, the fork jaw can be sandwiched between two knife jaws, which are configured for alternative opening and closing. The position and orientation of the utensils to each other and to the napkin is provided by the path traveled by the flatware clamp assembly 900.

Figure 12:
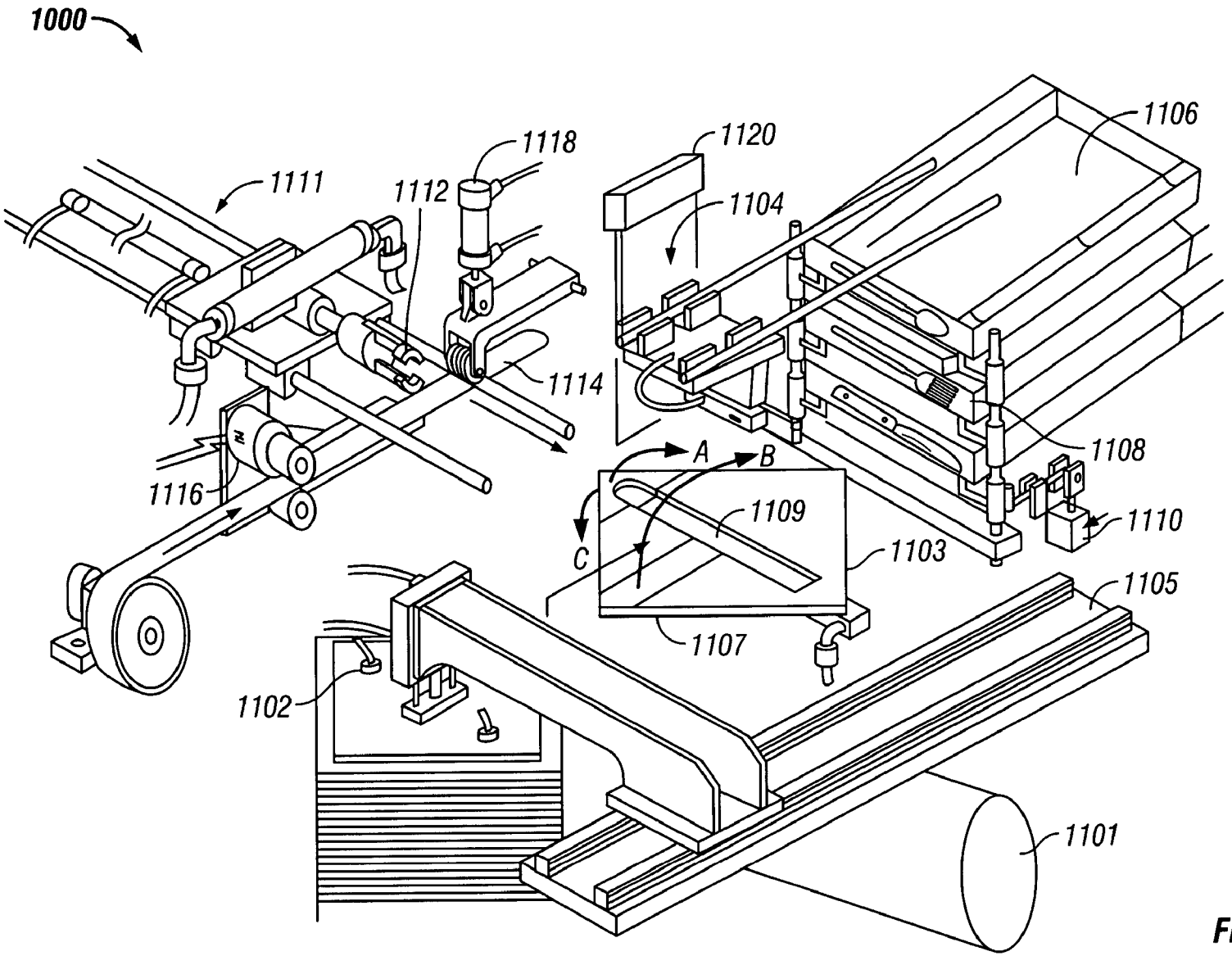
FIG. 12 shows a service pack assembly device in accordance with an alternative exemplary embodiment.

FIG. 12 shows an alternative embodiment of a device 1000 for assembling a service pack. The device 1000 includes a vacuum chuck 1102 powered by an air compressor and tank 1101. The vacuum chuck 1102 is configured to employ a vacuum force to a stack of napkins, which force will be adapted so that one napkin at a time is lifted from the stack of napkins. The vacuum chuck 1102 moves along a linear guide 1105 to place and orient the lifted napkin on folding stage 1103.

The device 1000 also includes a grabber 1104 that is positioned and movable to pick up one utensil from a utensil assembly 1106 that holds a number of utensils. The grabber 1104 may be adapted to pick up more than one utensil, such as one of each of a fork and knife, or a fork, knife and spoon. The grabber 1104 may pick up each utensil individually, or in a set. Each utensil picked up by grabber 1104 is positioned on the napkin on the folding stage 1103. The grabber 1104 can include a hand that includes a pneumatic cylinder to engage and disengage a pin or other type of mechanism, for grabbing the utensil.

The utensil assembly 1106 can include one or more cartridges holding utensils. The cartridges can be stacked. The utensil assembly 1106 also includes a sterilization system 1120 such as UV lights for sterilizing at least a utensil to be picked up by the grabber 1104 prior to positioning on the folding stage 1103. However, the sterilization system 1120 may be configured for sterilizing the utensils after they have been positioned on the folding stage 1103. The utensil assembly 1106 further includes a number of cylinders 1110 to push a utensil toward a position at which the grabber 1104 can engage the utensil.

The folding stage 1103 includes one or more leverage arms 1107 to fold the napkin over the utensils placed thereon. For example, a first leverage arm can fold a first corner over a lower end of the utensils, and a second leverage arm can fold the napkin from one side over to the opposite side of the utensils. The folding stage 1103 can include a channel 1109 that is sized for receiving the one or more utensils, to hold the utensils in place and assist in the folding process.

The device 1000 further includes a roller and banding assembly 1111, which includes a rotary grabber 1112 that is moved laterally toward the folded napkin and utensils to grab the napkin and utensil combination. The rotating grabber 1112 is moved by a rotating cylinder to rotate the grabbed napkin and utensil combination, and then retracted back to an original banding position above a napkin band strip 1114.

In the banding position, an electric motor 1116 or other mechanism drives the napkin band strip 1114 over the napkin/utensil combination. A roller 1118 activates to apply pressure to the band as the rotary grabber 1112 now rotates in an opposite direction to complete the banding operation. A portion of the napkin band strip is cut at a predetermined length, and the band is sealed around the napkin/utensil combination to create a service pack. The service pack is then dropped into a tray or forwarded to a service pack area for use.

Although a few embodiments have been described in detail above, other modifications are possible. For example, the one or more utensils can include a spoon. The napkin may be paper-based or linen-based. The utensils may be plastic-based or metal-based. The device may be adapted for high-throughput and/or high volume for large-scale operations. The device may also be adapted to allow more complex or elaborate napkin folding or design arrangements. The device may also be adapted to apply a logo to the napkin and/or napkin band/tape piece. Other embodiments may be within the scope of this document.

The invention claimed is:

1. A device for assembling a food service set comprising at least one napkin wrapped around one or more utensils and secured by an adhesive band, the device comprising:

a magazine subsystem including one or more magazines for containing and dispensing the at least one napkin, the one or more utensils, and the adhesive band;

an integrator subsystem configured to integrate the at least one napkin, the one or more utensils, and the adhesive band together, the integrator subsystem comprising a flatware clamp assembly comprising a clamp mechanism, the clamp mechanism being configured to pick up a single utensil from the one or more magazines and to move the single utensil to a specific position on the at least one napkin and to place the single utensil in a predetermined orientation;

a processor subsystem configured to roll the at least one napkin around the one or more utensils and to secure the adhesive band around the at least one napkin; and a receiver subsystem for receiving the service set.

2. A device in accordance with claim 1, further comprising an air compressor to power the integrator subsystem.

3. A device in accordance with claim 1, wherein the integrator subsystem includes a vacuum chuck and a folding stage, and wherein the vacuum chuck is configured for lifting a napkin and placing the napkin on the folding stage.

4. A device in accordance with claim 1, further comprising a sterilization system to sterilize the one or more utensils.

5. A device in accordance with claim 4, wherein the sterilization system comprises an ultraviolet light.

6. A device in accordance with claim 5, wherein the ultraviolet light is positioned to sterilize the single utensil as it is picked up by the clamp mechanism form the magazine.

7. A device in accordance with claim 5, wherein the ultraviolet light is positioned to sterilize the one or more utensils after they are placed by the clamp mechanism on the napkin.

8. A device in accordance with claim 1, wherein the clamp mechanism comprises a rotating structure that conveys the one or more utensils to a dispensing point from which the one or more utensils are deposited onto the at least one napkin.

9. A device comprising:

a folding mechanism configured to fold at least one napkin around a utensil set;

a napkin feeder that provides the at least one napkin onto the folding mechanism;

one or more utensil inlets configured to receive one or more cartridges containing utensils, the one or more cartridges each providing a single type of utensil in a stacked configuration;

a clamp mechanism configured to pick one of each type of utensil from the one or more cartridges to create the utensil set and to move it to and place it in a predetermined orientation upon the at least one napkin on the folding mechanism, a rolling mechanism configured to roll the at least one napkin around the utensil set, the rolling mechanism comprising a first roller that rotates in a first direction around a first rotational axis and a second roller that rotates in a second direction opposite to the first direction around a second rotational axis that is substantially parallel to the first rotational axis; and a tape feeder configured to provide a tape piece that is wrapped around the napkin and utensil set.

10. A device comprising:

a first magazine for holding a plurality of a first type of utensil and presenting one first utensil at a time;

a pivot arm comprising a jaw clamp at one end;

a platen for receiving a napkin to be wrapped around a service set that comprises the utensil;

a drive mechanism comprising a motor that rotates the pivot arm between a first position at which the jaw clamp grasps the presented first utensil from the first magazine and a second position at which the jaw clamp places the first utensil onto the napkin on the platen in a predetermined orientation to form a utensil set on the napkin; and means for wrapping the napkin around the utensil set.

11. A device in accordance with claim 10, wherein the jaw clamp rotates relative to the pivot arm prior to positioning the first utensil on the napkin on the platen.

12. A device in accordance with claim 10, further comprising a second magazine disposed adjacent to the first magazine for holding a plurality of a second type of utensil and presenting one of the second type of utensil at a time, wherein the drive mechanism rotates the pivot arm to a third position at which the jaw clamp grasps the presented second utensil and rotates back to the second position to add the second utensil to the utensil set in a predetermined orientation on the napkin on the platen.

13. A device in accordance with claim 10, wherein the means for wrapping the napkin around the utensil comprises:

a rolling mechanism that rolls the napkin around the utensil set, the rolling mechanism comprising a first roller that rotates in a first direction around a first rotational axis and a second roller that rotates in a second direction opposite to the first direction around a second rotational axis that is substantially parallel to the first rotational axis; and a tape feeder configured to provide a tape piece that is wrapped around the napkin and utensil set.

14. A device in accordance with claim 10, wherein the drive mechanism is disposed within the device such that the pivot arm is in an approximately horizontal orientation when the pivot an is in the first position and the second position is reached by dropping the jaw clamp to near the platen which is disposed at a level below that of the drive mechanism and the first magazine.

15. A device in accordance with claim 10, further comprising an ultraviolet light positioned to sterilize the first utensil as it is presented by the first magazine.

16. A device in accordance with claim 10, further comprising an ultraviolet light positioned to sterilize the utensil set on the napkin on the platen.

* * * * *